US008592788B1

(12) United States Patent
McGeoch

(10) Patent No.: US 8,592,788 B1
(45) Date of Patent: Nov. 26, 2013

(54) LITHIUM EXTREME ULTRAVIOLET SOURCE AND OPERATING METHOD

(71) Applicant: Plex LLC, Fall River, MA (US)

(72) Inventor: Malcolm W. McGeoch, Little Compton, RI (US)

(73) Assignee: Plex LLC, Fall River, MA (US)

( * ) Notice: Subject to any disclaimer, the term of this patent is extended or adjusted under 35 U.S.C. 154(b) by 0 days.

(21) Appl. No.: 13/775,663

(22) Filed: Feb. 25, 2013

(51) Int. Cl.
*H01J 1/24* (2006.01)
*H05G 2/00* (2006.01)

(52) U.S. Cl.
USPC ..... 250/504 R; 313/34; 313/12

(58) Field of Classification Search
USPC ..... 250/493.1, 503.1, 504 R; 313/11–13, 313/34–3, 475
See application file for complete search history.

(56) References Cited

U.S. PATENT DOCUMENTS 5,499,282 A 3/1996 Silfvast
7,479,646 B2 1/2009 McGeoch
7,518,300 B2 * 4/2009 Bosch et al. ..... 313/231.31
2009/0212241 A1 * 8/2009 McGeoch ..... 250/504 R
2009/0224182 A1 * 9/2009 McGeoch ..... 250/504 R
2012/0146510 A1 6/2012 McGeoch

FOREIGN PATENT DOCUMENTS

CH 301203 11/1954

OTHER PUBLICATIONS

M. Masnavi et al., "Estimation of the Lyman-α line intensity in a lithium-based discharge-produced plasma source", J. Appl. Phys., vol. 103, 013303 (2008).

* cited by examiner

*Primary Examiner* — Robert Kim
*Assistant Examiner* — David E Smith
(74) *Attorney, Agent, or Firm* — Wolf, Greenfield & Sacks, P.C.

(57) ABSTRACT

A plasma pinch extreme ultraviolet source using lithium vapor requires surrounding surfaces that are heated or cooled in order to evaporate the desired quantity of lithium, typically setting the vapor pressure of lithium at a pressure of a few torr. Two distinct surfaces within the whole set are designated as the electrodes that emit and receive the high current of the plasma pinch. A method is described whereby the temperature of these designated electrode surfaces is manipulated in order to condense lithium and provide a liquid metal protective layer to absorb both plasma and extreme ultraviolet heat thereby controlling electrode erosion. A further method is described that provides a protective flow of liquid lithium exactly on the axis of the pair of discharge electrodes.

14 Claims, 5 Drawing Sheets

LITHIUM EXTREME ULTRAVIOLET SOURCE AND OPERATING METHOD

FIELD OF INVENTION

This invention relates to plasma X-ray sources and, more particularly, to sources of soft X-ray or extreme ultraviolet photons.

BACKGROUND OF THE INVENTION

In the case of an extreme ultraviolet light source at 13.5 nm produced by a lithium plasma, it is difficult to design the electrode for least heat flux because the EUV light can carry even more heat than the plasma particles, and its propagation is not hindered by protection via for example an applied magnetic field. This combined flux of particles and EUV light can raise the electrode surface temperature transiently, raising the danger that the melting point of the electrode material could be approached, followed by flow of surface material and deformation of the electrode shape.

The general principle of surface protection via liquid metal from concentrated electric discharge heat is long established, having been the subject of Swiss Patent 301203, titled "Ignitron", awarded to Westinghouse in 1954. In that work the liquid metal, mercury, was delivered to the surface area containing the discharge location via porosity of the underlying substrate, which typically was a porous matrix of sintered tungsten or molybdenum. That approach allowed the ignitron to operate on the first pulse from cold, independent of device orientation, and protected the substrate from plasma erosion during a long operating life.

Subsequently, in U.S. Pat. No. 7,518,300 awarded to Philips, a discharge between electrodes, at least one of which is constructed from a matrix material or a carrier material, is claimed to reduce electrode erosion by providing charge carriers via evaporation and ionization of a sacrificial substrate material disposed within or upon the matrix or carrier material. The evaporated material may be partially ionized by a laser or other means to provide carriers for the discharge, thereby localizing the discharge and at the same time protecting the underlying carrier material.

SUMMARY OF THE INVENTION

In accordance with embodiments of the invention, electrode melting can be avoided by the production at an electrode tip of a layer of condensed liquid lithium, between pulses, in sufficient depth to absorb the heat of a pulse via evaporation, keeping the underlying electrode tip cool. In the present invention we describe a plasma extreme ultraviolet source and a method of operation of the source in which surface protection is provided by a thin liquid metal surface layer, in our case comprising lithium. In our approach sufficient electric discharge may be established independently via the magnetically assisted electrode configuration that is the subject of Patent Publication No. US 2012/0146510. This type of self-initiating discharge does not rely upon the generation of charge carriers that arise from the sacrificial substrate. We only require the protective lithium layer to absorb plasma heat and EUV radiation emitted from a plasma that has already been compressed in a plasma pinch that utilizes charge carriers generated elsewhere.

The capacity for a surface film of liquid lithium to absorb discharge or EUV heat is substantial. The latent heat of evaporation of lithium is 147 kJ/mole. Considering the molar volume of approximately 13.6=cm$^3$ (at the lithium melting point of 180 C), a 1 Joule pulse of energy may be absorbed through the evaporation of as little as $9\times10^{-5}$ cm$^3$ of lithium. Pulses of 1 J incident at 1 kHz may be absorbed via the evaporation of a lithium flow as small as 0.1 cm$^3$ sec$^{-1}$. It is an object of the present invention to create the required protective flow of lithium at or close to the tip of an electrode within an EUV source.

In the present invention a device and method are described for replenishment of that protective lithium layer via differential heating or cooling of the elements that comprise the wide-angle heat pipe discharge configuration of the subject type of EUV source. In particular, the two designated electrode elements may be cooled relative to the balance of the lithium return surface elements so that lithium condensation at or near to the electrode tips is enhanced, in order to create a protective lithium layer at the electrode tips. A further apparatus and method is described for production of a flow of protective liquid lithium that is exactly centered on the axis of the discharge, including the possibility of a lithium pump.

In accordance with a first aspect of the invention, there is provided a lithium plasma source of 13.5 nm light within a wide-angle buffer gas heat pipe containing two designated electrode structures and a plurality of heated cone-shaped structures wherein all the structures are initially heated to create a working lithium vapor density, then during repetitively pulsed operation the electrode structures are differentially cooled with respect to the cone-shaped structures so that lithium preferentially condenses on them to form a protective liquid layer between pulses.

In accordance with a second aspect of the invention, a plasma source comprises two electrode structures; two or more heated structures; a gas source configured to supply a working gas, wherein the electrode structures and the heated structures are heated during initial operation to form a working gas vapor density in a central region between the electrode structures and the heated structures; a pulse source configured to pulse the electrode structures during pulsed operation to form a plasma in the central region; and a cooling structure configured to cool the electrode structures with respect to the heated structures to form a liquid layer of the working gas on the electrode structures between pulses of the pulsed operation.

In accordance with a third aspect of the invention, a method for forming a plasma comprises establishing a working gas vapor density in a central region between two electrode structures and two or more heated structures, by heating of the electrode structures and the heated structures; pulsing the electrode structures during pulsed operation to form a plasma in the central region; and cooling the electrode structures with respect to the heated structures to form a liquid layer of the working gas on the electrode structures between pulses of the pulsed operation.

DETAILED DESCRIPTION

Embodiments of the present invention relate to refinements that may be appropriate to EUV sources based upon prior U.S. Pat. No. 7,479,646 "Extreme Ultraviolet Source with Wide Angle Vapor Containment and Reflux". The present invention may also be relevant to the protection of electrodes in a wide-angle vapor containment device that employs radio frequency heaters as described in U.S. patent application Ser. No. 13/326,043, "Induction Heated Buffer Gas Heat Pipe for use in an Extreme Ultraviolet Source," filed Dec. 14, 2011. The present invention also may be appropriate to EUV sources based upon Patent Publication No. US 2012/0146510. These documents are incorporated herein to the maximum extent allowable by law.

Figure 1:
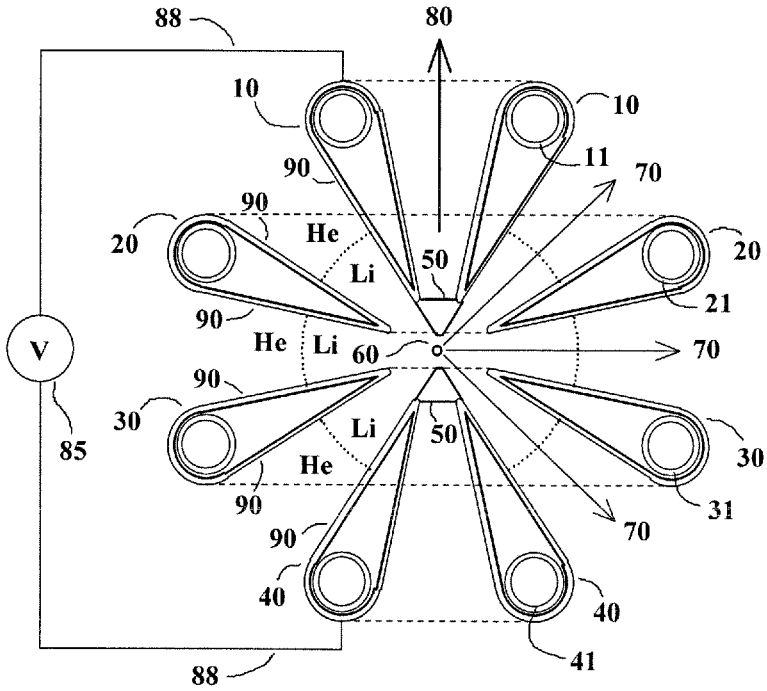
FIG. 1 is an illustration of a structure for the production of an electric discharge in lithium vapor.

A configuration for the production and maintenance of lithium vapor is shown in FIG. 1. With reference to that figure, which has a vertical axis of rotational symmetry 80, there are four separate structures 10, 20, 30, 40 which each are radio-frequency heated via internal coils 11, 21, 31, 41 respectively in order to set the temperature of all the most central surfaces with a view to establishment of a certain lithium density. There may be more than four structures in general. Two of the structures, in the case of FIG. 1 those labeled 10 and 40 are designated as the electrodes, shown attached by leads 88 to an external pulsed electrical supply 85. When an electric current of the order of 10 kA to 20 kA is pulsed between electrodes 10 and 40 through lithium vapor, a compact 20 electron volt plasma 60 is formed that emits 13.5 nm radiation from hydrogen-like lithium ions with very high efficiency. Particles, such as electrons and lithium ions, leave location 60 and may strike the electrode tips 50 of the designated electrodes, causing heating, and in some circumstances sputter erosion. In addition to the particle flux on to electrode tips 50, there is extreme ultraviolet (EUV) light emitted from plasma location 60.

Figure 2:
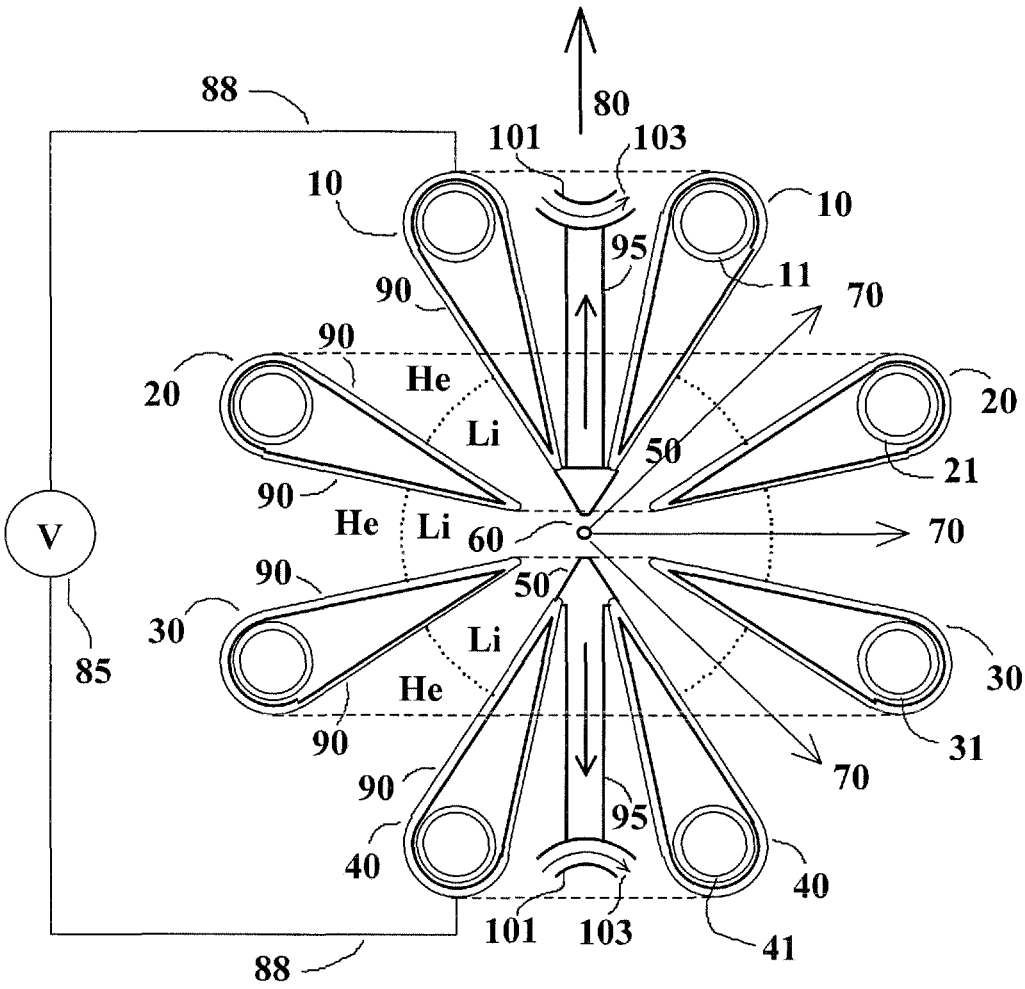
FIG. 2 shows an embodiment of the present invention with electrode cooling applied to the electrode tips

A first embodiment of the present invention is shown in FIG. 2. With reference to that figure, quasi-toroidal structures 10, 20, 30, 40 are shown in cross section in the plane that also contains rotational symmetry axis 80. Within each structure are radio frequency heater coils 11, 21, 31, 41 that heat by inducing currents on the inside surface of the hollow structures. These heating currents must flow to the innermost point of the structures in order to complete their current return loop, a flow pattern that is dictated by the toroidal topology of the structures. The application of radio frequency power to each of coils 11, 21, 31, 41 creates a hot central lithium vapor region as shown in FIG. 2 due to evaporation of lithium held on the surfaces 90 of the structures. As long as radio frequency power is being applied at the appropriate level, lithium that migrates outward condenses on the cooler outer parts of surfaces 90, flows inward again via capillary action, and is re-evaporated near the center. The outer boundary of the lithium vapor region is stabilized by a helium buffer while lithium displaces helium in the central region. Without differential temperature control, the electrode tips 50 are at approximately the same temperature as the inner parts of all surfaces 90, and thus lithium also evaporates from electrode tips 50 and cannot form a protective surface layer on them. Once the desired lithium density has been achieved, current pulses are applied from generator 85 that is connected to the electrodes via conductors 88. The current pulses induce hot, dense lithium plasma 60 to form at the central location on each pulse. This plasma emits EUV radiation in beams 70 that exit the device and are utilized elsewhere.

Once in pulsed operation, in order to prevent plasma heat and EUV radiation from overheating electrode tips 50, potentially causing melting, a regime of electrode cooling is then instituted whereby heat-conducting elements 95 remove heat from electrode tips 50 and themselves are cooled by contact with ducts 101 cooled by the passage of fluid 103 (this part of the device does not necessarily have rotational symmetry about axis 80). Elements 95 can operate via straight thermal conduction, phase-change cooling, or forced convection cooling. The phase-change method includes heat pipe cooling. At the same time as cooling is initiated via elements 95, heating via radio frequency coils 11 and 41 may be reduced to zero, or an appropriate low level. The rate of cooling via elements 95, and/or the radio frequency power to coils 11, 41, is/are controlled so that the temperature of electrode tips 50 rides below that of the center of the other cone-shaped heating surfaces powered (in this example) by radio frequency coils 21 and 31. This state allows preferential condensation on electrode tips 50 of a new layer of lithium between each pulse, thereby giving thermal protection to the electrode surfaces.

Figure 3:
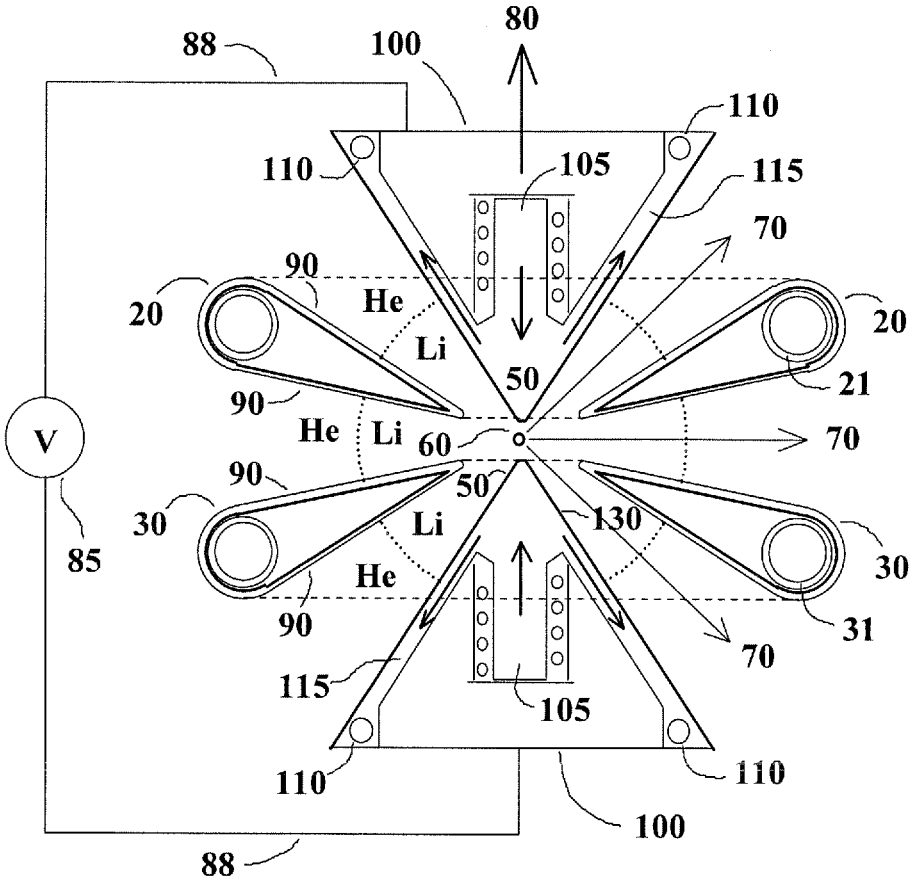
FIG. 3 shows an embodiment of the present invention with electrode cooling applied to regions adjacent to the electrode tips

A second embodiment of the invention is illustrated in FIG. 3. In this embodiment the two designated electrodes of approximately conical shape are labeled 100 and they are connected by leads 88 to pulsed power supply 85. The temperature of electrode tip regions 50 is set prior to the commencement of discharge pulsing by the rate of heating applied at heater structures 105. Heat flow, indicated by arrows in FIG. 3, is from heater structures 105 to the rear of electrode tips 50, then via thin-walled cone structures 115 to cooling channels 110 around the base of each electrode 100. Prior to pulsed discharge operation a working lithium vapor density is established via wide-angle heat pipe recirculation, established via the radio frequency heating of structures 90 and heating within the electrodes by heater elements 105. Once pulsed operation has begun, the rate of heating applied to heaters 105 is reduced, so as to compensate for discharge heating of electrode tips 50, and reduce the temperature of the electrode tips and their surrounds to the value at which lithium condensation is substantial. The principal condensation region 130 is close to the inner termination of cone walls 115. Lithium that has condensed at position 130 is able to migrate over the surface by capillary action toward electrode tips 50. This migration may be assisted by the presence of radial grooves running from region 130 toward electrode tip 50.

Figure 4:
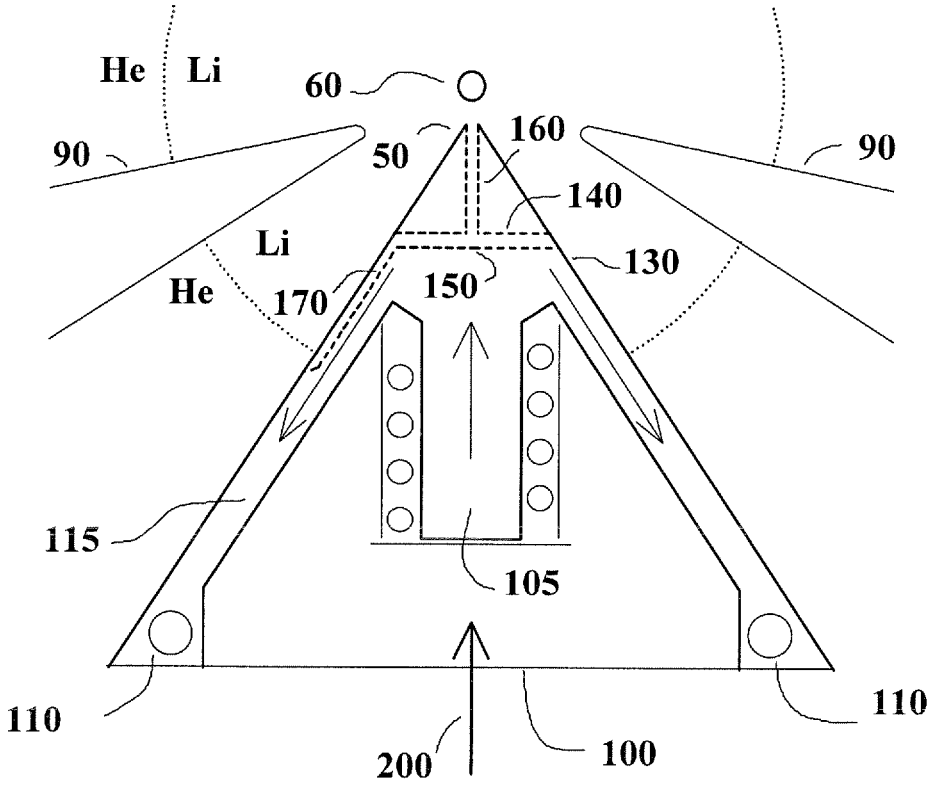
FIG. 4 shows a detail of an embodiment of the present invention like the one shown in FIG. 3, but with internal channels for lithium to flow to the electrode tips

A third embodiment of the invention is illustrated in FIG. 4 which shows a detailed view of the electrode tip region of an equipment that is overall similar to FIG. 3. In FIG. 4 there is implied a vertical axis of rotational symmetry 200. In this embodiment the structures bear the same labeling as in FIG. 3, but additional features are incorporated that feed liquid lithium via an internal channel or channels toward the exact tip 50 of each electrode. Channels 140 initially run from principal condensation region 130, converging at inner location 150. Lithium is then able to flow through single central channel 160 and emerge through the center of electrode tip 50. In this way, liquid lithium is delivered at precisely the most effective position for its task of evaporative electrode protection. As an additional aid to the return flow of lithium from condensation region 130 there may be radial grooves 170 that extend as far inward as the entry location to channels 140.

Figure 5:
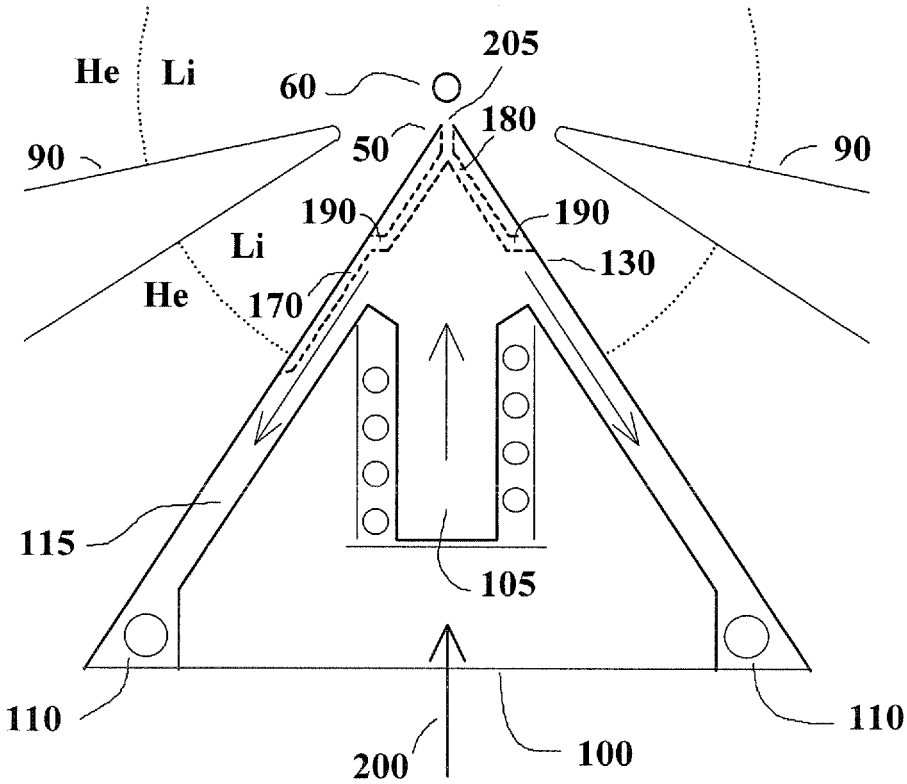
FIG. 5 shows a detail of an embodiment of the present invention like the one shown in FIG. 3, but with a cone-shaped internal channel for lithium to flow to an electrode tip

A fourth embodiment of the invention is illustrated in FIG. 5 which shows a detailed view of the electrode tip region of an equipment that is overall similar to FIG. 3. In FIG. 5 there is implied a vertical axis of rotational symmetry 200. In this embodiment the structures bear the same labeling as in FIG. 3, but additional features are incorporated that feed liquid lithium via an internal conical sheet channel 180 toward the exact tip 50 of each electrode. By "conical sheet channel" is intended an approximately cone-shaped hollow region that is of thickness small compared to its length. The flow exits through passage 205 connecting the apex of conical channel 180 with the tip region 50. The temperature of the electrode 100 surface is controlled so that lithium condensation is strongest in region 130. Condensed liquid lithium is drawn by capillary action up radial grooves 170 toward a plurality of entry holes 190, or a plurality of connecting narrow slots, at the top of each radial groove. Liquid lithium gains access via entry holes 190 to channel 180. In this way, liquid lithium is delivered at precisely the most effective position for its task of evaporative electrode protection. Such lithium flows may apply to either or both of the two electrodes in the plasma device.

Various pumping means may be deployed in order to move larger quantities of liquid lithium toward electrode tips 50 than available by capillary action alone. The pumping means have to be deployed at a location within, or in contact with, the lithium passageway between condensation regions 130 and electrode tips 50. Many different designs of pump are possible, but the principle of inserting a pump within this range of locations is the substance of one or more of the following claims.

Further realizations of this invention will be apparent to those skilled in the art. Having thus described several aspects of at least one embodiment of this invention it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A lithium plasma source of 13.5 nm light within a wide-angle buffer gas heat pipe containing two designated electrode structures and a plurality of heated cone-shaped structures wherein all the structures are initially heated to create a working lithium vapor density, then during repetitively pulsed operation the electrode structures are differentially cooled with respect to the cone-shaped structures so that lithium preferentially condenses on them to form a protective liquid layer between pulses.

2. A plasma source as in claim 1, in which the electrode tip region is directly cooled via conduction, phase change cooling, convection or a combination thereof.

3. A plasma source as in claim 1, in which an adjacent region on the electrode to its tip is directly cooled via conduction, phase change cooling, convection or a combination thereof.

4. A plasma source as in claim 3, in which grooves radiate from the electrode tip to the cooled adjacent region, to transport to the electrode tip via capillary action the lithium that has condensed in the adjacent region.

5. A plasma source as in claim 1, in which the electrodes have internal passages to intercept the return flow of liquid lithium at a location away from the electrode tips and transport liquid lithium so that it exits at the center of the electrode tips to form a protective surface layer in the tip region.

6. A plasma source as in claim 5, in which radial grooves transport liquid lithium from the condensation region to the entrance of the internal passages.

7. A plasma source as in claim 5, in which the internal passages comprise a plurality of holes intersecting on the axis of the electrode connecting at that location with a single axial hole providing flow to the electrode tip.

8. A plasma source as in claim 5, in which the internal passages comprise a plurality of holes or slots connecting from the condensation surface to the outer extremity of an internal cone-shaped single passage that feeds the electrode tip from its apex.

9. A plasma source as in claim 5, in which liquid lithium is moved toward the electrode tips by a pump located in or in contact with the said internal passages.

10. A plasma source comprising:

two electrode structures;

two or more heated structures;

a gas source configured to supply a working gas, wherein the electrode structures and the heated structures are heated during initial operation to form a working gas vapor density in a central region between the electrode structures and the heated structures;

a pulse source configured to pulse the electrode structures during pulsed operation to form a plasma in the central region; and a cooling structure configured to cool the electrode structures with respect to the heated structures to form a liquid layer of the working gas on the electrode structures between pulses of the pulsed operation.

11. A plasma source as defined in claim 10, wherein the working gas is lithium.

12. A plasma source as defined in claim 10, wherein the cooling structure includes heat conducting elements, controllable heated structures, channels in the electrode structures and/or grooves in the electrode structures.

13. A method for forming a plasma, comprising:

establishing a working gas vapor density in a central region between two electrode structures and two or more heated structures, by heating of the electrode structures and the heated structures;

pulsing the electrode structures during pulsed operation to form a plasma in the central region; and cooling the electrode structures with respect to the heated structures to form a liquid layer of the working gas on the electrode structures between pulses of the pulsed operation.

14. A method for forming a plasma as defined in claim 13, wherein the working gas is lithium.

* * * * *